United States Patent [19]

Goudreau et al.

[11] 4,415,155

[45] Nov. 15, 1983

[54] BATTING PRACTICE APPARATUS

[75] Inventors: Noel Goudreau, Bourbonnais; Nick Colevris, Bradley; Carl Southard, Bourbonnais, all of Ill.

[73] Assignee: Trico Products, Incorporated, Bradley, Ill.

[21] Appl. No.: 285,960

[22] Filed: Jul. 23, 1981

[51] Int. Cl.[3] ..... A63B 69/40

[52] U.S. Cl. ..... 273/26 E; 273/58 C; 46/51

[58] Field of Search ..... 273/26 E, 29 A, 58 C, 273/184 B, 185 C, 185 D, 196, 197 R, 330, 331; 46/51, 52; 403/78, 79, 80, 61

[56] References Cited

U.S. PATENT DOCUMENTS

| | | | |
|---|---|---|---|
| 2,751,226 | 6/1956 | Conway | 273/26 E |
| 3,907,287 | 9/1975 | Fox et al. | 273/26 E |
| 3,934,873 | 1/1976 | Griffin | 273/26 E |
| 4,186,921 | 2/1980 | Fox | 273/26 E |

*Primary Examiner*—Richard C. Pinkham

*Assistant Examiner*—T. Brown

*Attorney, Agent, or Firm*—Anthony S. Zummer

[57] ABSTRACT

This invention relates to a batting practice apparatus which includes an elongated axial rod which is particularly adapted to be gripped by an operator. An axle is fixed to one end of the rod. The axle is substantially parallel to the axis of the rod. A plate is mounted on the axle. The plate has a circular outer periphery. A swivel is movably mounted on the axle and has a portion engageble with the plate. A flexible line is connected to the swivel. A ball has a radial aperture contained therein, which aperture has an enlarged portion adjacent to one surface. The line has a portion positioned in the radial aperture. A metallic holding plate is mounted in the radial aperture. The holding plate has a rope aperture in its center. The line extends through the rope aperture in the holding plate and has a second portion in the enlarged aperture for securing the ball to the line. The line has a length more than two times greater than the length of the rod.

1 Claim, 4 Drawing Figures

FIG. 1
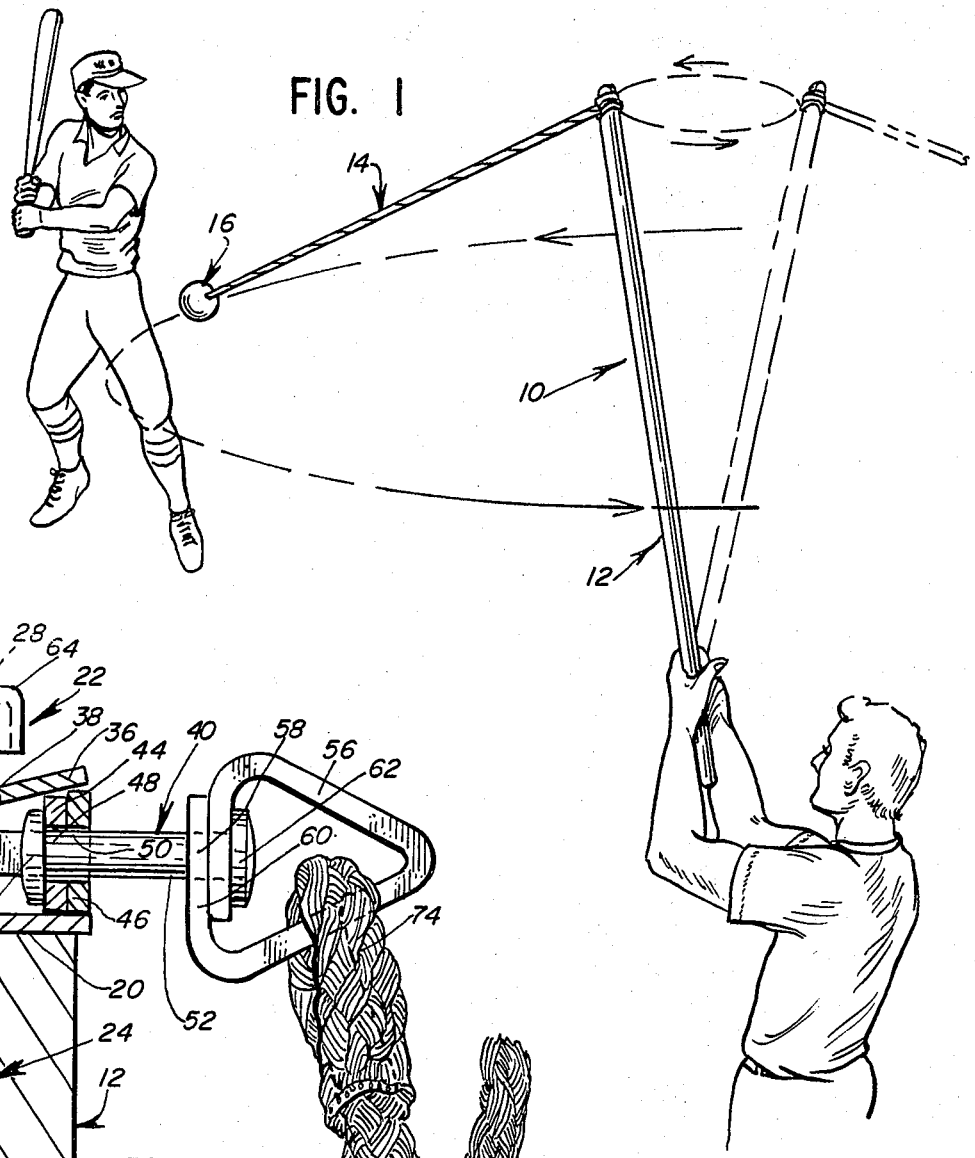
FIG. 2
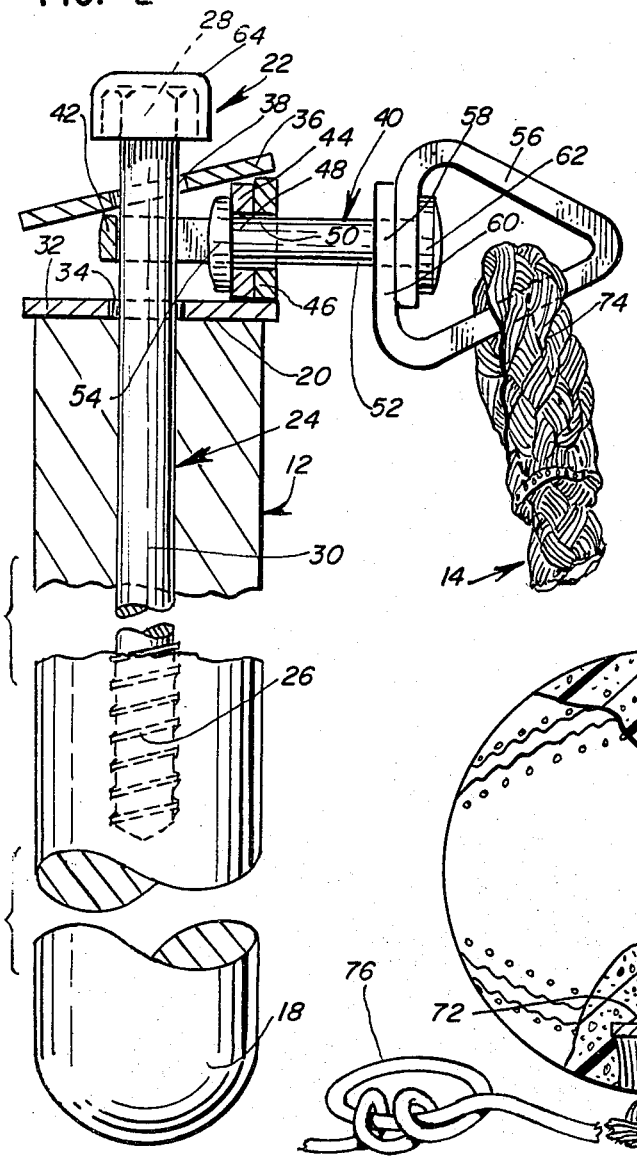
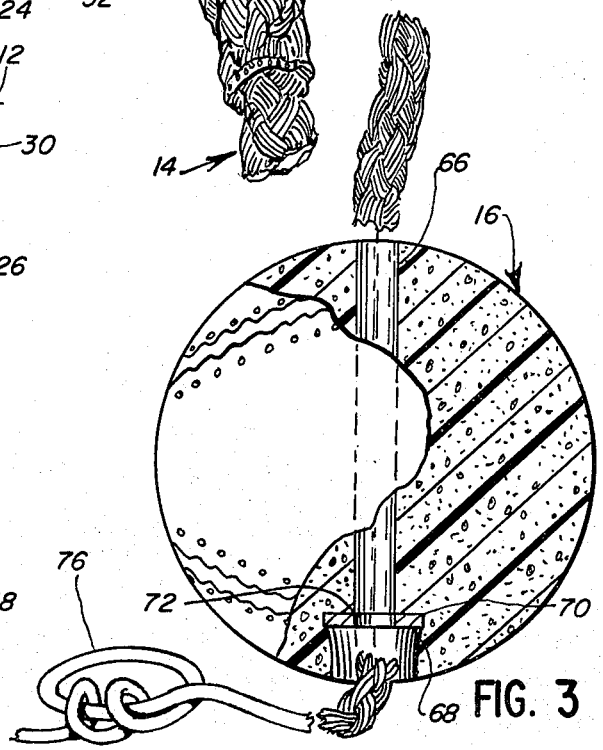
FIG. 3
FIG. 4
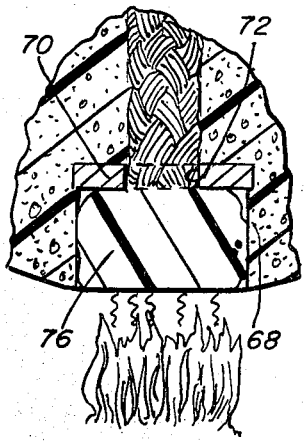

BATTING PRACTICE APPARATUS

BACKGROUND OF THE INVENTION

A common problem associated with baseball lies in providing an opportunity for players to have sufficient batting practice. Because of the size of a baseball field, it is necessary for a number of individuals to be out in the field to catch a ball after a batter has hit the ball. The use of batting cages has found wide acceptance because a pitcher may throw a ball toward a batter. If the batter hits the ball, the ball is usually retained in the batting cage. Batting cages, though useful, are expensive and require a substantial amount of space. Ordinarily, they are set up in a semi-permanent position so that a batting cage is not available for use by the average person. To this end, various batting practice apparatuses have been devised.

A well-known apparatus is one which includes a rod with a line having one end attached to a rod. A ball is attached to the other end of the line. As one person swings the rod, the ball on the other end of the line travels in a circle. A batter may swing at the ball and practice hitting the ball. If he is successful in hitting the ball, the ball is easily retrieved, in view of the fact that the ball is attached to the line. Examples of this type of apparatus are shown in U.S Pat. No. 2,547,476 to A. M. Rankin, issued Apr. 3, 1951, and entitled "Ball Throwing Device", and in U.S. Pat. No. 2,942,883 to W. H. Moore, issued June 28, 1960, and entitled "Baseball Batting Device". These two devices teach the broad concept of a batting practice device utilizing a rod, a line and a ball. These devices are satisfactory, however, the line connecting the ball to the stick may be easily broken after usage. It is to be noted that in the Moore device, the ball is held by a rope extending through the ball with the rope knotted together to make a loop. U.S. Pat. No. 3,934,873 to Griffin, issued Jan. 27, 1976, and entitled "Baseball Batting Aid" discloses a construction for securing a ball to a line. It will be noted that Griffin discloses the use of a radial aperture with an enlarged portion on one end. Griffin also teaches the utilization of a sleeve member in the enlarged portion of the opening.

SUMMARY OF THE INVENTION

The present invention relates to an improved construction of a batting practice apparatus. The apparatus includes an elongated cylindrical rod having a circular cross section, which is particularly adapted to be gripped by an operator. An axle is fixed to one end of the rod. A plate having a circular outer periphery and an opening in its center is rotatably mounted on the axle. A swivel is movably mounted on the axle. The swivel has a portion engageable with the plate. A flexible line is connected to the swivel. A ball is connected to the other end of the line. The ball has a radial aperture contained therein. The aperture has an enlarged portion adjacent to one surface of the ball. A metallic holding plate is mounted in the radial aperture. The holding plate has a rope opening in its center. The line has a portion positioned in the radial aperture extending through the rope opening in the holding plate. A second portion of the line in the enlarged aperture contains a knot to secure the ball to the line. The line has a length more than two times greater than the length of the rod.

BRIEF DESCRIPTION OF THE DRAWINGS

FIG. 1 is a perspective view of a baseball player and an operator, and the operator is holding a batting practice apparatus which is the subject matter of the present invention;

FIG. 2 is an enlarged fragmentary partial cross-sectional view of the batting practice apparatus of FIG. 1 showing the interior of the construction of the rod and a swivel including means for securing the swivel to the rod;

FIG. 3 is a partial cross-sectional view of a ball which is part of the apparatus of FIG. 1 showing a hollow braided line positioned in the ball and showing a knot used in connection with the rope; and FIG. 4 is an enlarged fragmentary view showing the braided line of FIG. 3 in an enlarged portion of the radial aperture.

DESCRIPTION OF THE PREFERRED EMBODIMENT

Referring now to the drawing and especially to FIG. 1, a batting practice apparatus embodying the present invention is shown therein and is generally indicated by numeral 10. The batting practice apparatus generally includes a rod 12 with a line 14 having one end connected to one end of rod 12, and a ball 16 secured to the other end of line 14.

Rod 12 is an elongated cylindrical wooden rod having a length of forty seven inches. The rod has a circular cross section and a rounded end 18. The other end of rod 12 is a flat surface 20, which other end has a connector 22 mounted thereon.

Connector 22 includes an elongated bolt 24, which has a threaded portion 29 secured in flat end 20 of rod 12. The bolt has a conventional hexagonal head 28. Bolt 24 includes an elongated body 30, which acts as an axle. The axis of bolt 24 is parallel to the axis of rod 12.

Connector 12 includes a lower plate 32 which has an aperture 34 in its center and is rotatably mounted on bolt 24. Plate 32 has a circular outer periphery. The diameter of the plate is greater than the diameter of rod 12. An upper plate 36 is also mounted on bolt 24. Upper plate 36 contains an aperture 38 which receives the bolt. Plate 36 has a circular outer periphery, which has a diameter equal to the diameter of plate 32.

A double swivel 40 is mounted on bolt 24 between plates 32 and 36. The swivel includes a collar 42 having a pair of collar arms 44 and 46 with apertures 48 and 50 contained therein. A stud 52 is rotatably mounted in apertures 48 and 50. Stud 52 includes a stud head 54 on one end to hold the stud in collar 42. An outer collar 56 identical to collar 42 is rotatably mounted on stud 52. Collar 56 has a pair of arms 58 and 60 which rotatably receive stud 52 through apertures contained therein. Stud 52 has a head 62 on the other end to hold the outer collar onto the stud. A vinyl cap 64 is mounted on head 28 covering the hexagonal head.

Ball 16 is a solid rubber ball having a radial aperture 66 extending through the ball. An enlarged aperture 68 is axially aligned with radial aperture 66. The ball has a steel holding plate 70 mounted in enlarged aperture 68. The holding plate 70 has a rope aperture 72 in its central portion for receiving a portion of line 14.

Line 14 is a hollow braided rope made of polypropylene fibers. The line has a loop 74 formed at one end in engagement with collar 56. The other end of line 14 extends through axial aperture 66 through rope aperture 72 in plate 70 and is formed in a knot 76. Knot 76 is a double bligh knot as shown in FIG. 3, which is tightened and then the knot is heated to melt the polypropylene and thereby fuse the strands of the rope together to secure the line to the ball.

The length of the line from the ball to the rod is nine feet and six inches, so that the length of the line is more than twice the length of the rod.

The instant batting practice apparatus is used by an operator holding the rod near rounded end 18, and swinging the rod in a circle; thus, swinging ball 16 in a larger circle. The operator controls the speed of the ball by rotating the ball faster or slower. By adjusting the attitude of the rod, the operator can adjust the height of the ball. A batter places himself in position adjacent to the path of the ball. The operator may adjust the speed of the ball as well as the height of the ball. The batter then has an opportunity to swing at the ball as it approaches him. Should he miss the ball he need only wait for the ball to complete another circle. However, should he hit the ball, the operator need only start to rotate the ball again. A skilled operator is capable of guiding a hit ball to cause the ball to fly in the opposite direction of rotation. The batter then may assume a batting position in the opposite direction, so that the batter has an opportunity to bat both, left handed and right handed thereby, improving his skills as a switch hitter.

The construction of the connector 22 is such that, even after the ball has been struck a substantial number of times, there is little wear on the interconnection between the rod and the line. The connector is arranged so that collar 42, which is a metallic part, rides on plate 32, which is also metallic, so that there is very little wear between the parts. Furthermore, the upper plate 36 limits the amount of upward movement of collar 42. The double swivel arrangement; that is, the ability of rod 52 to swivel in both collars 42 and 56, gives line 14 an opportunity to turn without twisting the line.

The knot in the end of the line is positioned in the enlarged aperture 68 to secure the line in the ball. Thus, the rope is locked in the ball at one end, but the other end is free to swivel in connector 22.

Although a specific embodiment of the herein disclosed invention has been described in detail above, it is readily apparent that those skilled in the art may make various modifications and changes without departing from the spirit and scope of the present invention. It is to be expressly understood that the instant invention is limited only by the appended claims.

What is claimed is:

1. A batting practice apparatus comprising; an elongated cylindrical rod being adapted to be gripped, said rod having a circular cross section along its length, an axle fixed to one end of the rod, said axle being substantially parallel to the axis of the rod, a wear plate movably mounted on the axle adjacent to the one end of the rod, said wear plate having a circular outer periphery and having a diameter greater than the diameter of the rod, an upper plate movably mounted on the axle, said upper plate having a circular outer periphery and having a diameter substantially equal to the diameter of the wear plate, said axle having an enlarged portion on its free end to retain the upper plate, a swivel rotatably mounted on the axle between the wear plate and the upper plate, said swivel having an inner collar rotatably receiving the axle, a portion of the inner collar engageable with the wear plate and the upper plate, a swivel stud rotatably mounted in the inner collar, an outer collar rotatably connected to the swivel stud, a braided polypropylene hollow rope having a closed loop positioned in the outer collar, a solid core ball having a radial aperture and an enlarged aperture aligned with the radial aperture, and a holding plate mounted in the enlarged aperture, said holding plate having a rope aperture aligned with the radial aperture, said braided rope positioned in the radial aperture and passing through the rope aperture of the holding plate, said rope having a portion knotted and fused together in the enlarged aperture to lock the rope to the ball, said rope having a length more than two times greater than the length of the rod.

* * * * *